US006588748B2

(12) United States Patent
Solow et al.

(10) Patent No.: US 6,588,748 B2
(45) Date of Patent: Jul. 8, 2003

(54) LIGHTED DICE

(75) Inventors: Joseph Solow, Deerpark, NY (US); Stanley Solow, Deerpark, NY (US)

(73) Assignee: Wolow Manufacturing Corp., Deer Park, NY (US)

( * ) Notice: Subject to any disclaimer, the term of this patent is extended or adjusted under 35 U.S.C. 154(b) by 0 days.

(21) Appl. No.: 09/879,608

(22) Filed: Jun. 12, 2001

(65) Prior Publication Data

US 2002/0185812 A1 Dec. 12, 2002

(51) Int. Cl.[7] ..... A63F 5/04; A63F 13/00

(52) U.S. Cl. ..... 273/146; 463/22

(58) Field of Search ..... 273/146; 463/11, 463/22; 428/28, 31, 42.1; 40/451, 452, 540, 546, 552, 593; 362/494, 503, 565, 806; 473/570; D11/95, 97, 121; D12/400

(56) References Cited

U.S. PATENT DOCUMENTS 2,227,406 A 12/1940 Christy
2,306,939 A * 12/1942 Ferris ..... 250/461.1
3,896,574 A 7/1975 McNaney
4,124,881 A 11/1978 Haber et al.
4,181,304 A * 1/1980 Haber ..... 273/146
4,431,189 A 2/1984 Wiencek et al.
4,480,294 A 10/1984 Carboni
4,641,840 A 2/1987 Larson
4,858,931 A * 8/1989 McKechnie ..... 463/22
4,989,120 A * 1/1991 Davis et al. ..... 362/35
5,016,145 A * 5/1991 Singleton ..... 362/503
5,791,966 A 8/1998 Capps et al.
5,913,616 A * 6/1999 Galella ..... 40/542
D425,442 S * 5/2000 Sims ..... D11/121
D427,962 S * 7/2000 Low ..... D12/400
6,082,880 A * 7/2000 Nerlino et al. ..... 362/493

* cited by examiner

*Primary Examiner*—Kim Nguyen
(74) *Attorney, Agent, or Firm*—Stephen E. Feldman, P.C.

(57) ABSTRACT

An illuminated novelty dice display having two opaque hollow dies with non-opaque dots on the die faces. The dots are illuminated by light sources within the hollow portions. The light sources are energized by an electric cord which may also be used to hang the dice from an overhead support such as a vehicle rear view mirror mounting bracket.

16 Claims, 1 Drawing Sheet

12
14
16
18
20
22
24
26
28
29
30
31
32
33
34
36
38
40
42
49
50
51
52
54

LIGHTED DICE

BACKGROUND OF THE INVENTION

Dice have been known for thousands of years, at least from the time of the early Egyptians as depicted on their monuments. Dice have been used not only for amusement and gambling, but also for decoration, for example a pair of dice secured together with a cord and suspended from a support such as the rear view mirror in an automobile. Frequently such decorative dice are embellished in some additional manner such as the presently popular furry dice.

DESCRIPTION OF THE PRIOR ART

The known dice comprise a small cube. On each of its six sides is placed a number ranging from one to six. The sum of the two numbers on the opposite sides of a die is always seven, thus if six is at the top, one is at the bottom and so on.

Usually, one, two, three or five dice are used in many games with the dice placed in a cylindrical box about four inches high and from one and a half to two inches in diameter. The box, open at the top is shaken and turned up quickly so that the dice will fall flat on a table. The aggregate amount of the spots uppermost at each throw are summed up and credited to the score of the thrower.

Various other gambling games are played by throwing the dice, including electronically and mechanically operated games that simulate the throwing of a pair of dice.

There are known types of so called electronic dice which are sometimes lighted to improve visibility of the dots or to simulate the rolling of dice by lighting one of the faces of a cube to display a digit rather than dots.

U.S. Pat. No. 2,306,939 to Ferris discloses a pair of dice with fluorescent paint or dye in the dots. When the dice are rolled on a surface (especially on a black surface) and under a black (ultra violet) light the dots will visibly glow.

Haber et al U.S. Pat. No. 4,124,881 teaches a pair of dice with a battery inside which is connected to light emitting diodes for illuminating dots on the faces. A gravity responsive switch on each face is connected so that only the uppermost face will be illuminated when a die comes to rest after being rolled.

U.S. Pat. No. 4,641,840 to Larson is directed to a plastic cube which supports a seven segment numeric display on each of its six facets. Within the cube, an electronic circuit including a random number generator and motion-sensing switch are supported. During cube motion, the electronic circuit is operative to impress various numbers on the numeric displays. Once motion ceases, the last occurring number is displayed on all six numeric displays. The disclosure of each of the foregoing patents is hereby incorporated by reference.

SUMMARY OF THE INVENTION

The present invention concerns a decorative display or novelty device similar to the popular furry dice which is usually hung above an automobile dashboard from the rearview mirror support. However such furry dice are usually flimsy static structures often made from foam material such as Styrofoam.

To the contrary the present invention has two die bodies each of which is made of a light weight and strong material such as rigid or flexible plastic with each die face having dots which can be illuminated. Instead of having an internal battery which is expensive and hard to replace, the illumination of the of the dots of the present invention is actuated by an external power source such as a cord connected to a jack for plugging into a cigarette lighter.

The dice of the present invention are preferably made of a light weight but strong material such as molded opaque plastic material with six die faces that enclose a hollow central portion where a source of illumination, such as a miniature 12 volt light bulb or a light emitting diode (LED) can be housed. Light weight is important so that the dice do not swing excessively or damage the windshield during emergency stopping. It is also preferable that the surface of the dice be covered with a fabric or flocking material to prevent unwanted reflections and have a soft exterior.

In addition the device of the present invention is sturdier and more durable than styrofoam structures of the prior art.

BRIEF DESCRIPTION OF THE DRAWINGS

Further objects and advantages of the present invention will become apparent to those skilled in the art upon review of the attached specification and drawings in which like reference numerals identify like elements and wherein.

DESCRIPTION OF THE PREFERRED EMBODIMENTS

Figures 1, 2, 3, 4:
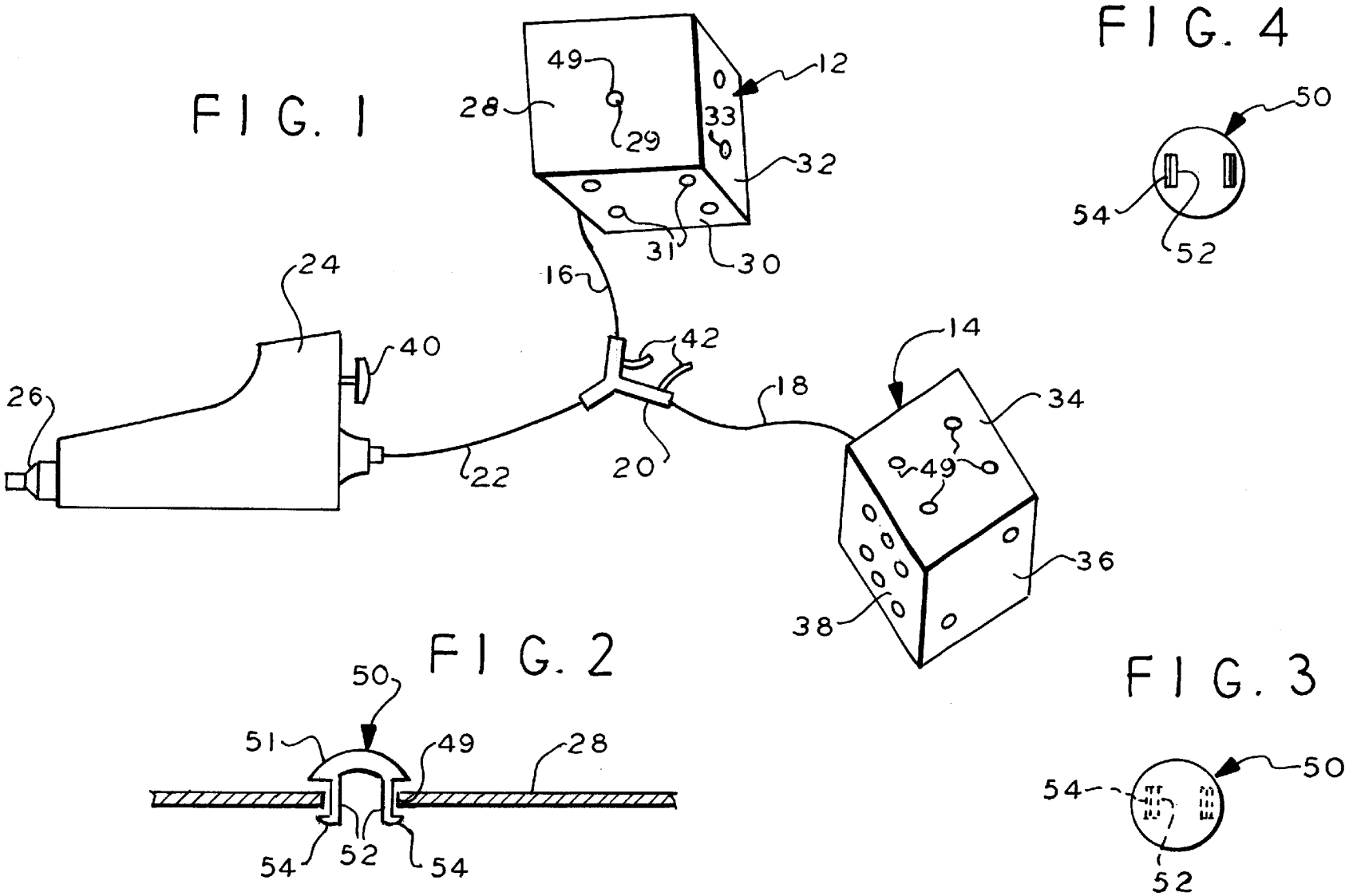
FIG. 1 is a perspective view of a pair of dice according to this invention.
FIG. 2 is an enlarged side view, partly in section, of a portion of a die face, showing a dot plug in elevation.
FIG. 3 is a top view of the dot plug of FIG. 2.
FIG. 4 is a bottom view of the dot plug of FIGS. 2 and 3.

In FIG. 1 there is shown a pair of dice comprising first die 12 and second die 14 connected by conductors 16 and 18 to a Y shaped fitting 20, which in turn has main conductor 22 leading to jack housing 24. Cigarette lighter adapter 26 is at the opposite end of housing 24 and when adaptor 26 is connected to a source of electric power, the illumination source in the first and second dies 12 and 14 will be energized to illuminate the dots under control of a control means 40.

First die 12 has six faces, only three of which are shown: face 28 has single dot 29, face 30 has four dots 31 and face 32 has two dots 33. As is the usual custom in dice construction the number of dots on the opposing faces not shown would be such that total number of dots on two opposing faces would equal seven, i.e. the face opposite face 28 would have six dots, the face opposite face 30 would have three dots and the face opposite face 32 would have five dots.

The dots disbursement of second die 14 is similar to that of first die 12 discussed above, i.e. opposite two dot face 36 is five dots, opposite four dot face 34 is three dots, and opposite six dot face 38 is a single dot.

It should be understood that the routing of conductors 16-22 is only one example; optionally main conductor 22 could run directly to either first die 12 or second die 14 with a subsequent bridging conductor between the two dies. However the illustrated arrangement is presently preferred because Y fitting 20 can be hooked over a rear view mirror support and conductors 16 and 18 can then be used to support dies 12 and 14. Alternatively Y fitting 20 may have securing means such as an extending metal or plastic hook or strap means 42 with hook and loop ("Velcro") surfaces designed for wrapping around and securing the Y connector to the rear view mirror support.

The dots 29, 31, 33, etc. have an associated light emitting source, preferably a single miniature 12 volt light bulb or a light emitting diode (LED) in each die. It is also contemplated to use a plurality of bulbs or LEDs, e g one for each dot. All such bulbs or LEDs on a particular face would be connected together to be energized at the same time and be illuminated simultaneously e.g. all four dots on face 30 or all six dots on face 38.

Each of the dies may be separately controllable, the arrangement being such that under usual circumstances all of the dots on all of the faces of one of dies are illuminated but none of the dots on the other die are illuminated.

In a preferred arrangement, all of the dots on a particular face, when illuminated, would be steadily illuminated, that is, not flashing. However it is also contemplated that for some display effects, the dots on one face, or even all the dots on all the faces could be flashed on and off.

The energization of the light source for either steady illumination or flashing illumination is actuated by a control means 40 in the form of an off/on switch which is preferably located on the jack housing 24; alternatively the control means could be located in the Y fitting 20 or in one or both of the first and second dies 12 and/or 14.

The dots on the faces of each die are formed of a non-opaque (translucent or transparent) material such as molded plastic. These dots can be non-opaque integral parts of the material of the otherwise opaque die faces, but the dots are preferably separately molded plastic plugs 50 that are fitted into openings in the die faces.

As illustrated in FIGS. 2–4, a dot plug 50 is fitted into an opening 49 in a die face, with an interference fit. For purpose of illustration the die face 28 is shown, but of course the same type of dot plug 50 would be used in any of the die faces 28, 30, 32, 34, 36, or 38. The dot plugs 50 are preferably all of the same size except on face 28 where the single opening 49 and the dot plug 50 may be of a larger diameter for the sake of visual effect.

The dot plugs 50 preferably have an outwardly curved outer face 51 and an inner face with at least two projecting fingers 52, for frictionally engagement with the sidewall of opening 49. Preferably at least one finger on each dot plug 50 has a radially outward extending hook 54 to engage the inner surface of the adjacent die face to prevent accidental removal of the plug 50 from the opening 49.

In the foregoing description of the invention certain terms have been used for conciseness, clarity, and comprehension. However, no unnecessary limitations are to be implied from or because of the terms used, beyond the requirements of the prior art, because such terms are used for descriptive purposes and are intended to be broadly construed. Furthermore the description and illustrations of the invention are by way of example, and the scope of the invention is not limited to the exact details shown, represented, or described.

While the present invention has been described with reference to specific embodiments, it is understood that the invention is not so limited but rather includes any and all changes and modifications thereto which would be apparent to those skilled in the art and which come within the spirit and scope of the appended claims.

What is claimed is:

1. An illuminable novelty dice display comprising:

a pair of dice for hanging downwardly from a-support, said dice comprising a first die and a second die;

said first die having a central portion and at least six faces, each face having at least one dot;

said second die having a central portion and at least six faces, each face having at least one dot;

a light source within each of said central portions;

conductor means for electrically connecting said light sources to an external power source;

control means associated with said conductor means for selectively energizing said light sources so that at least one dot on a face of said one of said first die and second die can be controllably illuminated, or at least one dot on a single face of said first die is illuminated simultaneously with at least one dot on a single face of said second die.

2. The dice display of claim 1 in which the conductor means includes a jack for insertion into a vehicle cigarette lighter.

3. The dice display of claim 2 in which the control means is associated with a housing for said jack to be inserted into the vehicle cigarette lighter.

4. An illuminable novelty dice display comprising:

a pair of dice for hanging downwardly from a support, said dice comprising a first die and a second die;

said first die and said second die each having a hollow central portion defined by at least six die faces, each die face being opaque except for at least one illuminable dot;

at least one light source within each of said hollow central portions, said at least one light source being capable of illuminating said at least one illuminable dot;

conductor means for electrically connecting said light sources to an external electric power source;

control means associated with said conductor means for selectively energizing at least one of said light sources so that at least one illuminable dot on a face of at least one die can be controllably illuminated, or at least one dot on a single face of said first die is illuminated simultaneously with at least one dot on a single face of said second die.

5. The dice display of claim 4 in which the conductor means includes a jack for insertion into a vehicle cigarette lighter.

6. The dice display of claim 4 in which the control means is associated with a housing for a jack to be inserted into a vehicle cigarette lighter.

7. The dice display of claim 4 in which at least one die is a hollow molded plastic body having at least one opening in each said die face; and a plurality of non-opaque plastic plugs for fitting into said openings for passage therethrough of light from said light source.

8. The dice display of claim 7 in which said die faces have external surfaces covered by a flocked material except in the area of said openings.

9. The dice display of claim 7 in which said plastic plugs have an outer face and an inner face with projecting fingers for frictional engagement with walls of said openings.

10. An illuminable novelty dice display comprising:

a pair of dice for hanging downwardly from a support including an automobile rear view mirror support bracket, said dice comprising first and second dies of a hollow molded plastic material;

said first and second dies each having a hollow central portion defined by at least six die faces, each die face being opaque with openings in said faces;

a light source within each said hollow central portion;

a plurality of non opaque plugs for fitting into said openings for passage of light therethrough to form discernable dots on said dice faces;

conductor means for electrically connecting said light source to an external electric power source, said conductor means comprising a jack for insertion into a vehicle cigarette lighter;

control means associated with said conductor means for selectively energizing said light sources so that at least one dot on a face of said one of said first die and second die can be controllably illuminated, or at least one dot on a single face of said first die is illuminated simultaneously with at least one dot on a single face of said second die.

11. The dice display of claim 10 in which said jack includes said control means for at least one of said first and second dies.

12. The dice display of claim 10 in which said conductor means includes a Y shaped connection between said dies.

13. The dice display of claim 10 in which said die faces have external surfaces covered by a flocked material except in the area of said openings.

14. The dice display of claim 10 in which said non-opaque plugs have an outer face and an inner face with projecting fingers for frictional engagement with walls of said openings.

15. The dice display of claim 10 in which the conductor means comprises a first electric cable extending from said jack to a Y shaped connector, second and third electric cable extending from said Y shaped connector respectively to said first and second dies; and Y shaped connection being useable for engagement over support including the rear view mirror support bracket.

16. The dice display of claim 15 including means on said Y shaped connector for engaging said rear view support bracket.

* * * * *